United States Patent [19]

Braun

[11] Patent Number: 4,999,650

[45] Date of Patent: Mar. 12, 1991

[54] BUBBLE JET PRINT HEAD HAVING IMPROVED MULTIPLEX ACTUATION CONSTRUCTION

[75] Inventor: Hilarion Braun, Xenia, Ohio

[73] Assignee: Eastman Kodak Company, Rochester, N.Y.

[21] Appl. No.: 451,709

[22] Filed: Dec. 18, 1989

[51] Int. Cl.[5] ..... B41J 2/05

[52] U.S. Cl. ..... 346/140 R

[58] Field of Search ..... 346/140 R, 1.1, 76 PH

[56] References Cited

U.S. PATENT DOCUMENTS

| | | | |
|---|---|---|---|
| 4,429,321 | 1/1984 | Matsumoto | 346/140 R |
| 4,463,359 | 7/1984 | Ayata et al. | 346/1.1 |
| 4,575,737 | 3/1986 | Vermot-Gaud et al. | 346/140 R |
| 4,695,853 | 9/1987 | Hackleman et al. | 346/140 R |
| 4,791,440 | 12/1988 | Eldridge et al. | 346/140 R |
| 4,847,630 | 7/1989 | Bhaskar et al. | 346/1.1 |
| 4,862,197 | 9/1989 | Stoffel | 346/140 R |

*Primary Examiner*—Mark J. Reinhart
*Assistant Examiner*—Victor DeVito
*Attorney, Agent, or Firm*—John D. Husser

[57] ABSTRACT

A multiplex drop ejection construction for a drop-on-demand, ink jet printer. The construction includes a support substrate; a first circuit portion having branches that include a resistive heater element and a diode device formed in spaced relation on the substrate. A dielectric passivation layer overlies the first circuit portion except at the discrete terminal regions of the first circuit portion branches. A second circuit portion comprising a plurality of multiplex electrode lines overlies the passivation layer and includes connection sections extending through the passivation layer into contact with terminal regions of the first circuit. A second passivation layer overlies the second circuit portion, but not the resistive heater elements.

2 Claims, 4 Drawing Sheets

FIG. 2
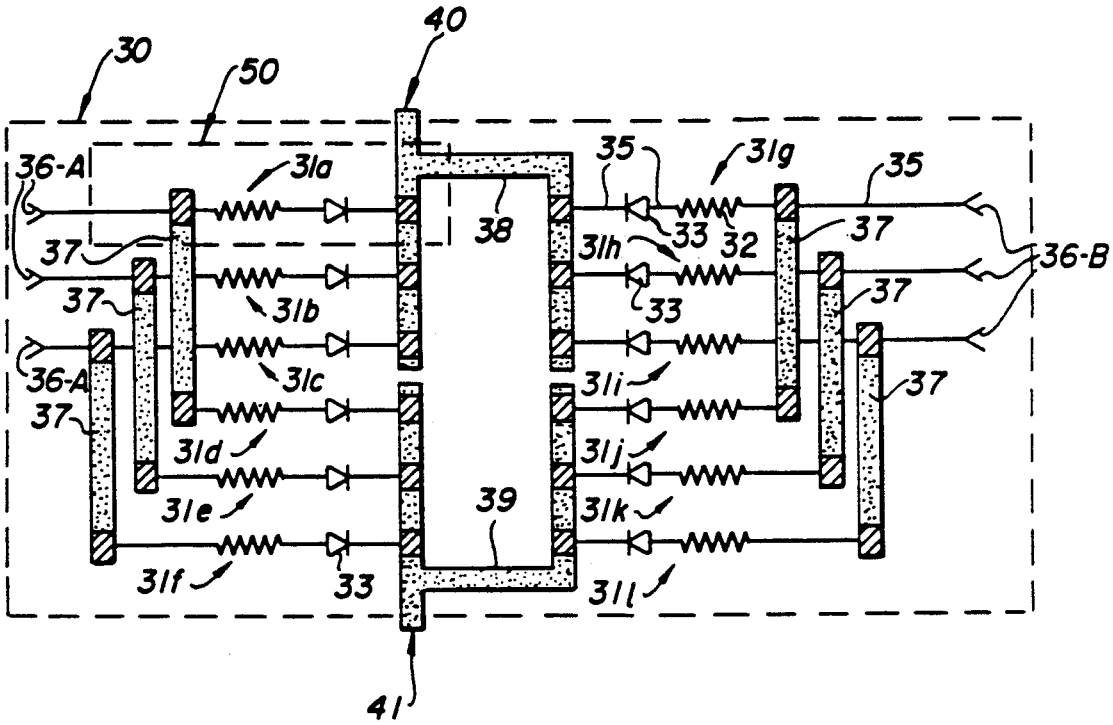
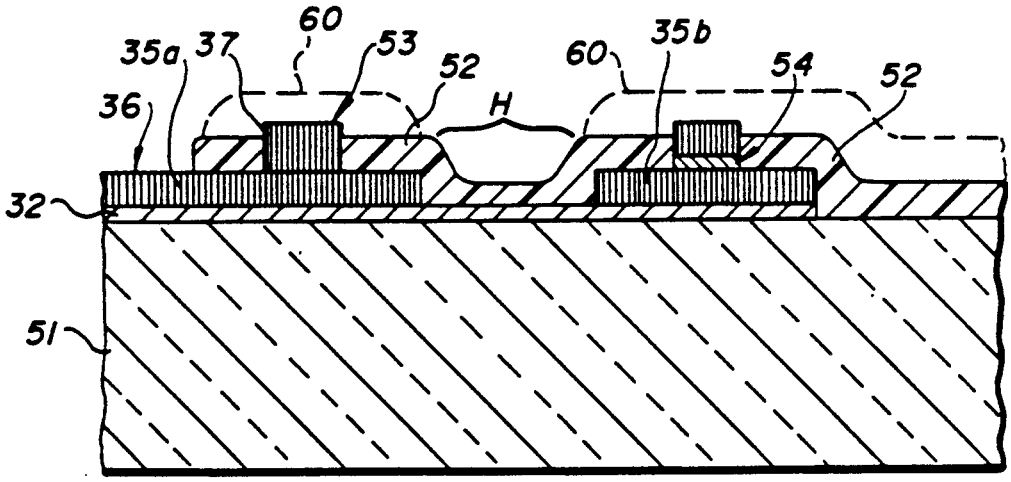
FIG. 3

BUBBLE JET PRINT HEAD HAVING IMPROVED MULTIPLEX ACTUATION CONSTRUCTION

FIELD OF INVENTION

The present invention relates to thermal, drop-on-demand, ink jet (herein termed "bubble jet") printing and, more particularly, to improved print head constructions for enabling high density printing.

BACKGROUND ART

Typically, in bubble jet print heads a plurality of electrically resistive heater elements are deposited on a support substrate that is formed e.g. of metal or silicon and has a heat control coating, e.g. $SiO_2$. Metal electrodes are formed to selectively apply voltage across the heater elements and a protective coating is provided over the heater elements and electrodes. Printing ink is supplied between and heater elements and orifices of the print head and heater elements are selectively energized to a temperature that converts the adjacent ink to steam rapidly, so that a shock wave causes ejection of ink from the related orifice.

As the development and commercial use of the bubble jet technology progresses, there is increased interest in increasing the resolution of those systems. In this context, system resolution can be thought of as the number of pixel drops printed within a given print region (e.g. line length). One way to increase system resolution is to interlace ink drops, e.g. with multiple passes vis a vis a single array of orifices, or by providing a plurality of scanning orifice arrays. This approach simplifies the print head (s) construction, but requires accurate positioning of the print heads vis a vis the print media to assure good registration of the drops from separate passes.

Another way to increase system resolution is to increase the line density of drop ejector subsystems (i.e. orifices and related heater elements) on a single print head. This can be done with one or a plurality of linear orifice arrays (see e.g. U.S. Pat. No. 4,734,717). Photofabrication techniques enable construction of such high density orifice plate and heater subsystems; however, a present limit to increasing system resolution is presented by the difficulty in making electrical connections between a large number of heating resistors formed on a tiny chip and the electrical address electronics of the printer control system.

To reduce the problem presented by the large number of addressing leads, several systems have been proposed for multiplexing the address of (i.e. the provision of energizing current through) the resistive heater elements of bubble jet print heads. For example, U.S. Pat. No. 4,695,853 discloses a bubble jet chip construction wherein an x-y electrode matrix is constructed with one matrix electrode portion underlying a pattern of resistor/diodes and the other matrix electrode portion overlying the resistor/diode pattern. The x-y electrode portions are separated by an electrically insulative layer except at the resistor/diode components where they form "vertically" disposed, sandwiching terminals. While this resistor/diode construction allows for multiplexing (and thus reduces leads and terminals necessary for address), it has several problems. First, during multiplexing as described in the '853 patent, diode reverse leakage to the upper electrode can cause electrolytic attack that can destroy the electrode traces. Second, it is extremely difficult to equalize forward resistance in a diode while maintaining a fixed resistance value in the heater resistor element.

U.S. Pat. No. 4,791,440 discloses another solution to the problem of providing a high resolution print head with a large number of drop-ejection sites. In this approach, one array of electrical connections to the sites is provided on the top side of the chip substrate and another array of site connections is provided on the bottom side of the substrate. A plurality of holes are provided through the substrate material to couple the top and bottom side lead matrices. To further simplify the electrical lead situation, this approach provides also a multiplex address system wherein a plurality of heater arrays are activated at different phases by an array-select voltage pulse, which, when coupled with a particular heat site data pulse, will provide sufficient heater corrent to eject an ink drop. The '440 patent approach is a difficult one to fabricate, necessitating the forming of multiple holes though the substrate and photofabrication work on both sides of the substrate. In some applications coupling to the printer via the chip bottom surface is not possible. Also, the multiplex system causes unnecessary partial energizations of all heater elements during each active phase of an array. This can cause dissolved gas release from the ink resulting in a bubble which blocks jet activity or ink replenishment.

SUMMARY OF INVENTION

A significant purpose of the present invention is to provide an improved construction for a high resolution bubble jet print head which avoids the problems of prior art appraches such as described above. Thus, one advantage of the present invention is to enable relatively simple fabrication of a bubble jet print head having a large number of high density drop ejection sites. Another advantage of the present invention is provision of a multiplex print head construction that operates more reliably and efficiently than prior art approaches.

The life of a bubble jet heater array resistor, like that of a light bulb, is a very strong function of the voltage at which it is operated. Thus, it is desirable to operate such elements as close to the bubble formation threshold as possible. They may have, for example, a life of only a few cycles at 25% above threshold, but a life of several million cycles at 10% above threshold. Since there are manufacturing tolerances in the supply voltage, various lead resistances, and the threshold voltage, and the desire is to extract excellent life (by operating close to the bubble formation threshold) all resistance variations should be held to a minimum. Because semiconductor diodes in contrast to ordinary conductors decrease their forward resistance as they increase in temperature, the use of diodes in an ink heating region creates great potential for overall circuit resistance variation, if not thermal runaway. Thus, use of resistor/diodes, as in the '853 patent, is not desirable from the viewpoint of a long device operating life.

In one aspect, the present invention provides an improved construction for a drop-on-demand, ink jet printer of the kind having a plurality of orifices, a thin film drop ejector, including heater elements, and manifold means for supplying ink to the heater elements. The improved construction constitutes a drop ejection device having (i) a support substrate; (ii) a first circuit comprising a plurality of circuit branches that each include a resistive heater element and a diode device, formed in spaced relation on the substrate; (iii) a dielectric passivation layer overlying the first circuit except at the discrete terminal regions; (iv) a second circuit comprising a plurality of multiplex electrode lines overlying the passivation layer and including connection sections extending through the passivation layer into contact with terminal regions of the first circuit; and (v) a second passivation layer overlying the second circuit portion but not overlying the resistive heater elements.

BRIEF DESCRIPTION OF DRAWINGS

FIG. 2 is an enlarged schematic illustration of the circuit structures of the drop ejection device of the FIG. 1 printer assembly;

FIG. 3 is an enlarged cross-section of a portion of the circuit structure shown in FIG. 2.

DETAILED DESCRIPTION OF PREFERRED EMBODIMENTS

Figure 1:
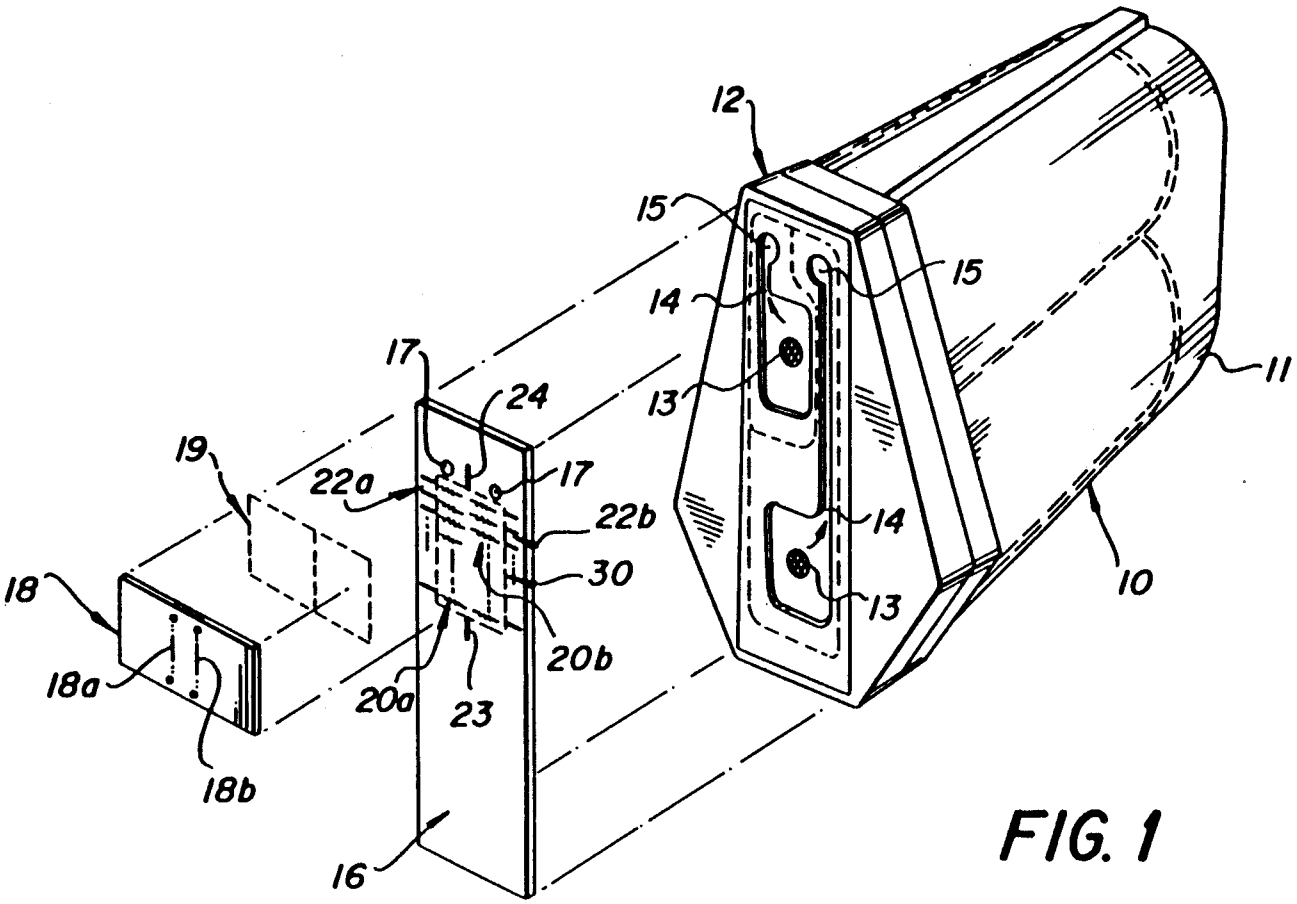
FIG. 1 is an exploded perspective view of one ink jet print/cartridge assembly incorporating the present invention.

FIG. 1 illustrates one bubble jet print/cartridge embodiment of the present invention, which is a modification of the print/cartridge described in U.S. Pat. No. 4,734,717. In general, the print/cartridge 10 comprises an ink reservoir portion 11 having a cap 12 with filtering ink supply openings 13 that lead via supply passages 14 to manifold regions 15. A drop ejection chip 16 mounts over the top of the cap and has openings 17 aligned with manifold region 15. An orifice plate 18 having two linear arrays of orifices 18*a*, 18*b* is mounted, by a printed adhesive pattern 19, over the top of openings 17 and the resistive heater elements formed in corresponding arrays 20*a*, 20*b* on the top surface of the drop ejection chip. As shown generally in FIG. 1, the chip 16 also group address electrodes 22*a*, 22*b* and group selection electrodes 23, 24. A significant aspect of the present invention is the improved construction and function of the chip 16 and its circuits, which are described in detail subsequently. However, to complete the general description of the print/cartridge it should be explained that ink is supplied, e.g. by capillary action, from the ink reservoir to regions over the resistive heater elements. Current pulses are selectively directed via chip electrodes, through the heater elements, in accord with information signals that gate driver circuits (not shown). The current pulses heat the resistive elements, which vaporize adjacent ink to eject drops of ink from the related orifices.

Referring to FIG. 2, a portion of the chip 16, designated by dotted line 30, is shown in enlarged schematic plan view. In general, the circuit system comprises a first circuit portion, which is formed on a substrate and is indicated by solid lines, second circuit portions (indicated by stippled regions) and a dielectric passivation layer (not shown) intermediate the two circuit portions. More specifically, it can be seen that the first circuit portion comprises a plurality of branch subcircuits 31*a*–31L that each include a resistive heater element 32 and a diode 33 formed in spaced relation on the substrate and coupled by electrode lines 35 (see subcircuit 31*g*). Branch electrode lines for subcircuits 31*a*–31*c* and 31*g*–31*i* extend directly to terminals 36-A, 36-B which are connectible to print pulse drive circuits (not shown).

The second circuit portion comprises six coupling electrode portions 37, which connect the input terminals 36-A, 36-B to respective lines of subcircuits 31*c*–31*d* and 31*j*–31L, and two group selection electrodes 38, 39 which are coupled respectively to the opposite ends of subcircuit lines to form subcircuit selection group I (31*a*–31*c* and 31*g*–31*i*) and group II (31*d*–31*f* and 31*j*–31L). Selection electrode 38 extends to a group I selection terminal 40 and selection electrode 39 extends to group II selection terminal 41. The cross-hatched areas on the stippled second circuit indicated regions where the electrode extends through the intermediate dielectric passivation layer to make contact with the first circuit portion branches. Otherwise the two circuit portions are electrically isolated from one another by the dielectric passivation layer.

FIG. 3 shown a cross-section of a portion of one actual circuit structure, such as illustrated schematically within the dotted line box 50 of FIG. 2. Thus, substrate 51 can comprise a glass or glazed silicon chip having a heat control top surface (not shown) on which a resistive metal layer 32 (e.g. TaAl or $HfB_2$) is formed. Electrode leads 35*a*, 35*b* are deposited onto the resistive layer except over the ink heating region H so that current will pass from one electrode to another, down through the resistive layer at the heating region. First passivation layer 52, e.g. $SiO_2$, is formed over the electrodes and heater elements except at regions 53, 54. At region 53, a coupling portion of electrode 37 extends into contact with address electrode 35*a* and over the surface of the dielectric passivation layer 52 to couple with branch circuit 31*c* (not shown in FIG. 3). At region 54 a diode layer, (e.g. comprising silicon and gold) is first deposited and then a coupling portion of group select electrode 38 is deposited to extend over layer 52 to terminal 40 (not showin FIG. 3). A second passivation, e.g. polyamide, layer 60 is then formed over the regions 53, 54 and other top surfaces of the chip, but not over heating region H.

Figure 4E:
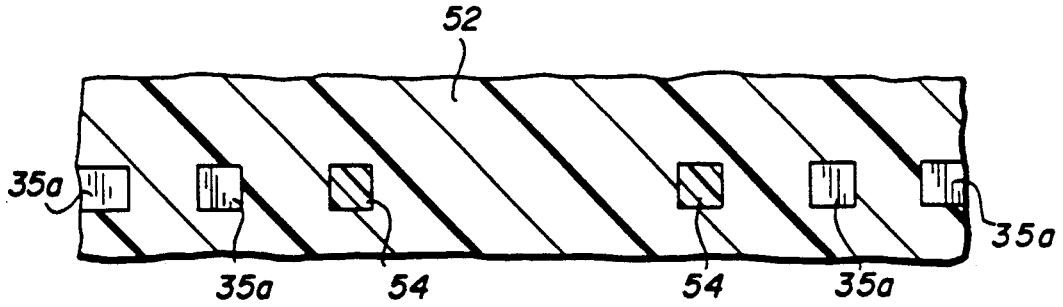
FIGS. 4A to 4G are schematic plan views illustrating successive stages of fabricating the circuit structure portions shown in FIG. 3.
Figure 4F:
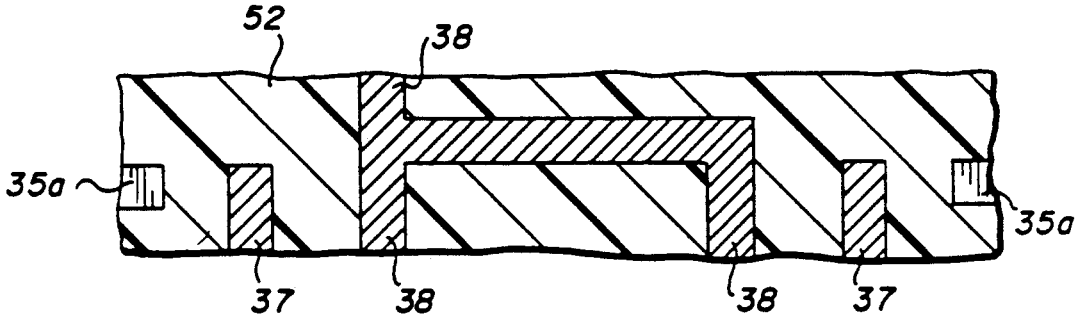
Figure 4G:
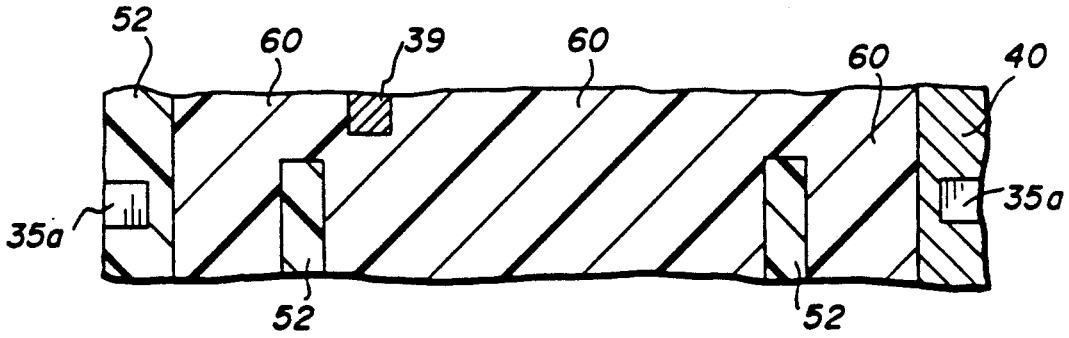
Figure 4A:
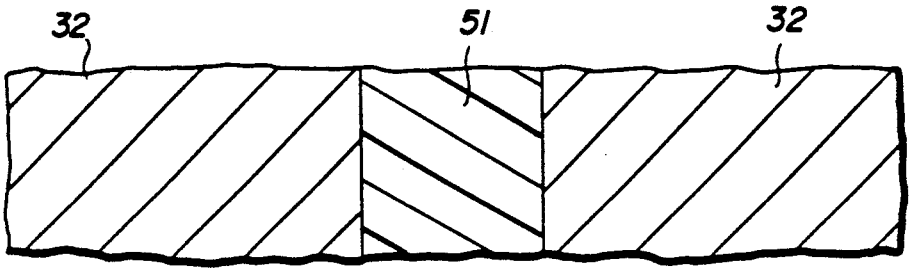
Figure 4B:
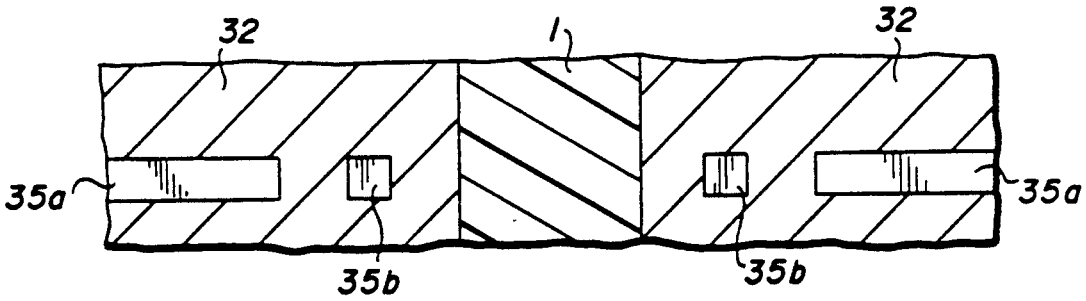
Figure 4C:
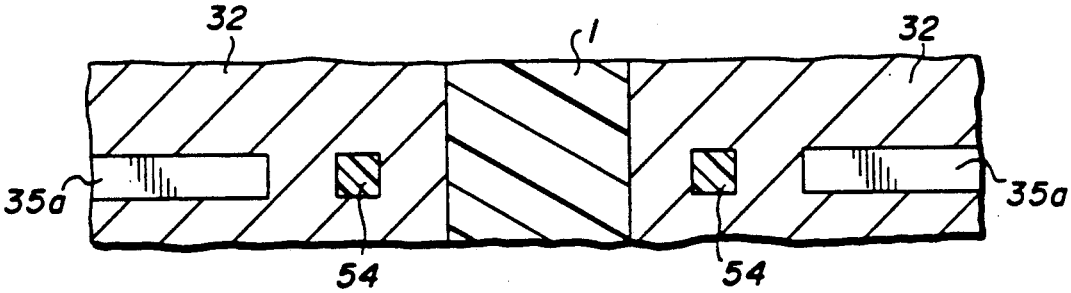
Figure 4D:
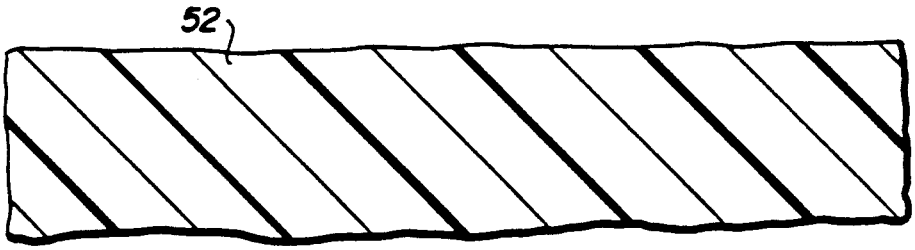

Reference to the fabrication sequences of the portion shown in FIG. 3, as illustrated in FIGS. 4A–4G, will assist in understanding the chip construction according to the present invention. As shown in FIG. 4A a layer 32 of resistive material is first deposited on the surface of substrate 51 in regions that include the eventual heat transfer region. Next, as shown in FIG. 4B, metal electrodes 35*a* and 35*b* are formed with ends defining the current path through the resistive material at the heating region. A layer (s) of diode material 54 is then deposited onto the top of electrodes 35*b*, see FIG. 4C, and a dielectric passivation layer 52 (e.g. $SiO_2$ or Zr) is deposited over the surface as shown in FIG. 4D.

Referring to FIG. 4E, it can be seen that the passivation layer is patterned to reveal portions of electrode 35*a* and diods 54. At this stage, if Zr is used for formation of layer 52 it can be oxidized to form $ZrO_2$. The second circuit portion comprising electrodes 37, 38 are then deposited and patterned in the configuration shown in FIG. 4F, and finally the second passivation layer 60 is deposited and patterned to provide a chip having the topography shown in FIG. 4G. It should be noted that layer 60 can be polyamide or similar material because it is not overlying the heat transfer path, wherein layer 52 provides the protective cover for the resistive heater elements.

Referring again to FIGS. 2 and 3, in operation, enable pulses are sequentially applied to terminals 40 and 41. During enable of electrode 38, the diodes of branch circuits 31*a*–31*c* and 31*g*–31*i* are forwardly biased and when driver pulses are applied to the terminals 36-A, 36-B in accord with information signals electrodes 35 of those circuits can conduct current through resistive heaters of the circuits to heat overlying ink and effect bubble jetting of an ink drop through their corresponding orifice of orifice plate 18. When an enable pulse is operative on terminal 41, electrode 39 forwardly biasing the diodes of branch circuits 31*d*–31*f* and 31*j*–31L so that driver pulses applied to terminals 36-A and 36-B are transmitted to respective ones of those branch circuits (via coupling electrodes 37) to similarly effect drop ejections in accord with information signal gating the driver circuits.

Thus, the circuit constrction embodiment described above in accord with the present invention provides the advantages of multiplexing operation without the necessity of patterning two sides of drop ejection chip. Moreover, the circuit constructions of the present invention remove the circuit diode elements from the regions of heat generation. As noted previously, this is particularly important in devices using thin film circuit components which are operated repeatedly at high duty cycles, such as the bubble jet printing devices described above.

The invention has been described in detail with particular reference to certain preferred embodiments thereof, but it will be understood that variations and modification can be effected within the spirit and scope of the invention.

I claim:

1. In a drop-on-demand ink jet printer of the kind having a plurality of orifices, a thin film drop ejection device including a corresponding plurality of drop ejection heater elements and manifold means of supplying ink to said heater elements, the improvement wherein said drop ejection device comprises:

(a) a support substrate;

(b) a first circuit portion comprising a plurality of circuit branches that each include a resistive heater element and a diode device formed in spaced relation on said substrate and coupled in series by first circuit branch electrode lines to terminal regions;

(c) a dielectric passivation layer overlying said first circuit portion except at the discrete terminal regions of said first circuit portion branches;

(d) a second circuit portion comprising a plurality of multiplex electrode lines overlying said dielectric passivation layer including connection sections extending through said dielective passivation layer into contact with terminal regions of said first circuit portion; and (e) a second passivation layer overlying said second circuit portion, but not overlying said resistive heater elements.

2. The invention defined in claim 1 wherein said first circuit portion comprises at least two of said circuit branches and said second circuit portion comprises:

(i) an electrode line coupling the print pulse input sides of said circuit branches to a common driver circuit terminal; and (ii) seperate electrode lines respectively coupling the diode outputs of said circuit branches to separate enable terminals.

* * * * *